US010107065B2

(12) United States Patent
Duphorne et al.

(10) Patent No.: US 10,107,065 B2
(45) Date of Patent: Oct. 23, 2018

(54) THROUGH-TUBING DEPLOYED ANNULAR ISOLATION DEVICE AND METHOD

(71) Applicants: Darin Duphorne, Houston, TX (US); Erik Vilhelm Nordenstam, The Woodlands, TX (US)

(72) Inventors: Darin Duphorne, Houston, TX (US); Erik Vilhelm Nordenstam, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 278 days.

(21) Appl. No.: 14/959,359

(22) Filed: Dec. 4, 2015

(65) Prior Publication Data

US 2017/0159396 A1 Jun. 8, 2017

(51) Int. Cl.
*E21B 33/12* (2006.01)

(52) U.S. Cl.
CPC ..... *E21B 33/12* (2013.01)

(58) Field of Classification Search
CPC .. E21B 2033/005; E21B 33/12; E21B 43/108; E21B 43/103; E21B 33/1208
See application file for complete search history.

(56) References Cited

U.S. PATENT DOCUMENTS 2,780,294 A * 2/1957 Loomis ..... E21B 33/1208 277/339
2,828,823 A * 4/1958 Mounce ..... C10L 1/221 277/331
3,038,542 A * 6/1962 Loomis ..... E21B 33/12 166/187
3,583,292 A * 6/1971 Garnier ..... E21B 23/10 92/182
4,754,543 A * 7/1988 Spivy ..... B26D 3/16 279/2.1
4,923,007 A * 5/1990 Sanford ..... E21B 33/1277 166/187
5,318,122 A 6/1994 Murray et al.
5,322,127 A 6/1994 McNair
5,388,648 A 2/1995 Jordan, Jr.
6,598,672 B2 * 7/2003 Bell ..... E21B 33/1216 166/118
8,474,528 B2 * 7/2013 Peixoto ..... E21B 17/1014 138/112
9,353,606 B2 * 5/2016 Bruce ..... E21B 33/1277
2004/0040703 A1 * 3/2004 Longmore ..... E21B 43/082 166/207
2004/0261994 A1 * 12/2004 Nguyen ..... E21B 43/088 166/278
2005/0173126 A1 * 8/2005 Starr ..... E21B 33/12 166/376
2006/0272806 A1 * 12/2006 Wilkie ..... E21B 33/1208 166/192
2007/0114017 A1 * 5/2007 Brezinski ..... E21B 33/12 166/179

(Continued)

*Primary Examiner* — Kipp C Wallace
(74) *Attorney, Agent, or Firm* — Cantor Colburn LLP

(57) ABSTRACT

A through-tubing annular isolation device includes a plurality of building elements tethered sequentially together such that a tubular form is achieved at a second energy condition and a dimensionally smaller form is achieved at a first energy condition. A method for isolating an annular space through-tubing.

19 Claims, 6 Drawing Sheets

(56) References Cited

U.S. PATENT DOCUMENTS

| | | | | |
|---|---|---|---|---|
| 2009/0025929 | A1* | 1/2009 | Buytaert | E21B 17/1028 166/244.1 |
| 2010/0071911 | A1* | 3/2010 | Carree | E21B 33/1277 166/386 |
| 2014/0251640 | A1* | 9/2014 | Zimmerman | E21B 33/128 166/387 |
| 2016/0230496 | A1* | 8/2016 | Lastra | E21B 33/128 |

* cited by examiner

THROUGH-TUBING DEPLOYED ANNULAR ISOLATION DEVICE AND METHOD

BACKGROUND

In the hydrocarbon exploration and recovery industry many distinct types of completions are used for many various formation types and borehole trajectories. In addition, over time, methods and devices for completions change and too the formations change in target fluid volume and capture. These realities can instigate a need for alterations to existing completed wellbores and sometimes a need for actions in boreholes still being completed that might otherwise have been attended by different means but for actions already taken.

One particular example of the foregoing is through tubing efforts that must maintain a minimum ID (inside diameter) in a wellbore being altered. Running tools through tubing requires that the OD (outside diameter) of the tool be at least somewhat smaller in diameter than the ID of the tubing through which the tool is being run. If a formation borehole into which the tool is to be deployed is of a significantly larger ID, then difficulties of maintaining the running in dimensions of less than the ID of the tubing becomes an even greater dilemma due to the significant expansion required when the tool is deployed.

In view of the foregoing, the art would well receive methods and apparatus to deploy tools in wellbores as above described.

SUMMARY

A through-tubing annular isolation device including a plurality of building elements tethered sequentially together such that a tubular form is achieved at a second energy condition and a dimensionally smaller form is achieved at a first energy condition.

A through tubing annular isolation device includes a plurality of building elements tethered or assembled together such that the building elements are dimensionally passable through an inside dimension of a tubing string and such that a tubular form dimensionally larger than the inside dimension of the tubing string is achievable from the building elements when deployed beyond an end of the tubing string.

A method for isolating an annular space through-tubing includes a through-tubing annular isolation device including a plurality of building elements tethered sequentially together such that a tubular form is achieved at a second energy condition and a dimensionally smaller form is achieved at a first energy condition at a first energy condition into a tubing; running the device through the tubing; and deploying the device beyond the tubing.

BRIEF DESCRIPTION OF DRAWINGS

The following descriptions should not be considered limiting in any way. With reference to the accompanying drawings, like elements are numbered alike.

DETAILED DESCRIPTION

Broadly, this disclosure relates to a through tubing annular isolation device that uses a plurality of building elements tethered or assembled together such that the building elements are dimensionally passable through an inside dimension of a tubing string and such that a tubular form dimensionally larger than the inside dimension of the tubing string is achievable from the building elements when deployed beyond an end of the tubing string. This allows an operator to extend a tubing string for whatever reason such is needed without pulling the string out of the borehole. Rather, additional length of tubing string may be repeatedly added to extend the string in a structurally competent and sealed manner.

Figure 1:
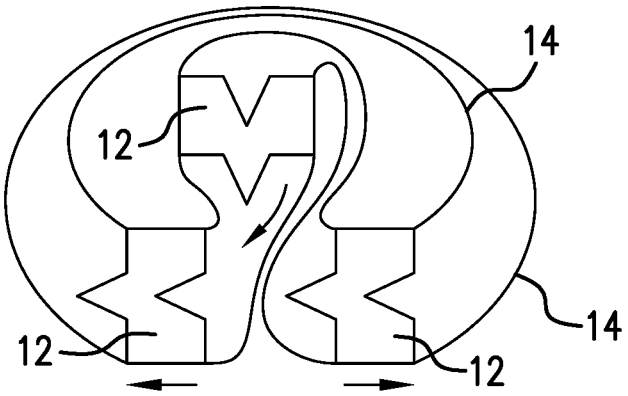
FIG. 1 is a schematic illustration of one embodiment of a through-tubing deployed annular isolation device in a collapsed form.
Figure 2:
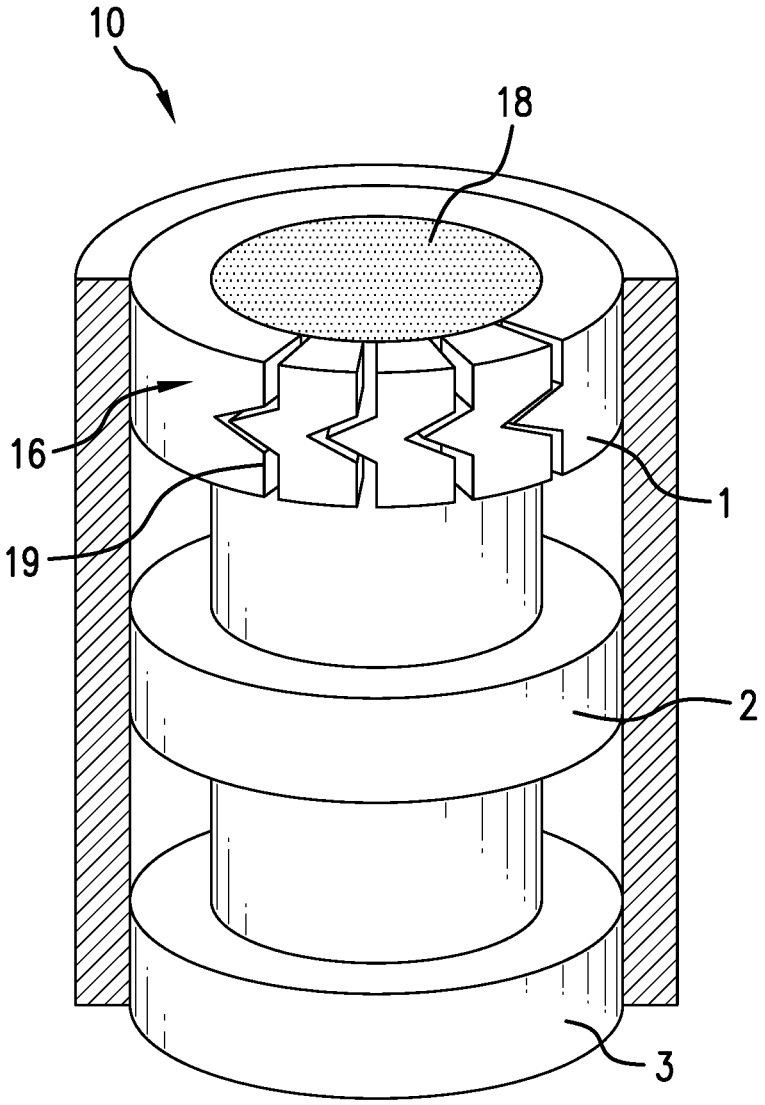
FIG. 2 is the embodiment of FIG. 1 in a deployed form.

Referring to FIG. 1, a through-tubing annular isolation device 10 is illustrated in a collapsed form (which in some embodiments is a higher energy condition and in some embodiments is a lower energy condition and so herein is termed a first energy condition) so that the device may be run through-tubing. The device comprises a plurality of building elements such as blocks 12 that in one embodiment are all of one shape although it is to be appreciated that embodiments where the blocks 12 are of distinct shapes is also contemplated providing that the blocks 12 are nestable to create a tubular shape when allowed to take that form. The blocks 12 are tethered to one another in such a way as to allow the blocks to be moved from a second energy condition (which in some embodiments may be a lower energy condition and in some embodiments may be a higher energy condition and is termed herein a second energy condition) (deployed condition lower energy in FIG. 1) to a first energy condition (collapsed condition higher energy in FIG. 1) and then snap back to the second energy condition when permitted. One embodiment particularly illustrated in FIG. 1 employs one or more elastic elements 14 that run through each of the blocks 12 as illustrated. In the second energy condition (lower in this embodiment), the blocks are aligned with one another to form the tubular form 16 illustrated in FIG. 2. Driving the blocks toward an axis of the tubular form 16 will cause the plurality of blocks 12 collectively to assume the collapsed condition and the elastic element(s) 14 to stretch and hence acquire the first energy condition (higher in this embodiment). This simultaneously causes the plurality of blocks to have a generally much smaller outside dimension. To illustrate the concept one example would be a 6.625 inch size deployed condition and a collapsed condition of less than 3.75 inches in general outside dimensions. As one will readily appreciate, this would provide for a common sized structure for an annular isolation device that could be delivered to a target location through existing tubing having only a 3.75 inch ID.

In another embodiment, the blocks do not include element (s) 14 but rather are each magnetized or provided with magnets thereon or therein such that the magnetic fields will tend to realign the blocks in a lower energy condition if permitted to do so, i.e. after exiting from the tubing through which the device is delivered to the target location. The building elements are thus tethered by magnetism.

Figure 3:
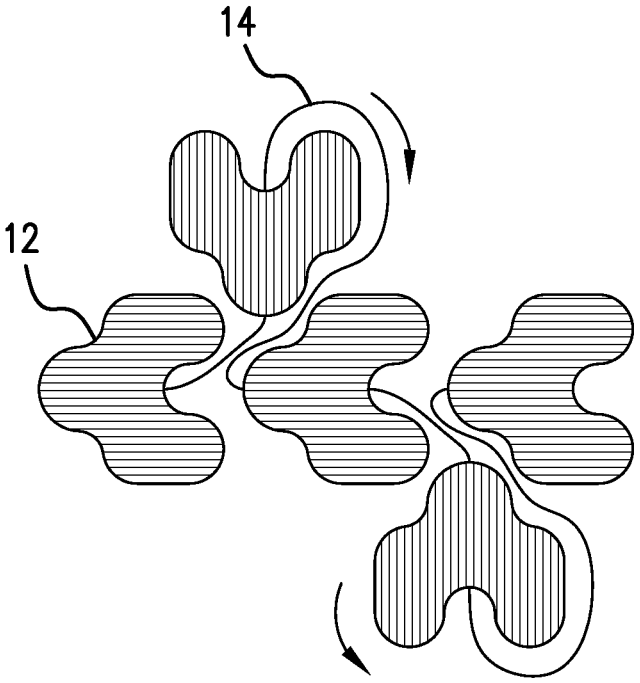
FIG. 3 is a schematic illustration of an alternate block configuration.
Figure 4:
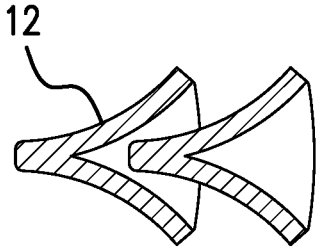
FIG. 4 is a schematic illustration of another alternate block configuration.

FIGS. 3 and 4 schematically illustrate alternate configurations of the blocks 12.

In an iteration of the embodiments of FIG. 1, regardless of which block configuration is used, at least a minimum number of blocks are provided with a material thereon that is configured to at least one of urge the blocks to the tubular form and seal the blocks together and or to the formation of another tubular. One or both of these may be accomplished by adding a sealing material 19 which may be a swellable material disposed upon one or more of the blocks. The material may be on each block, on every other block etc., limited only by the ability of the material and it's positioning causing the condition (acquiring the tubular form and/or sealing) that is intended in the embodiment. In one embodiment the material is a swellable so that a swellable seal is created radially outwardly of the tubular form 16, radially inwardly of the tubular form 16, both radially inwardly and radially outwardly of the tubular form 16, between the blocks 12 and any combination of the foregoing or combinations including one or more of the foregoing. Further, embodiments may employ a shape memory material instead such as a polymer and in some instances a foam (e.g. Geofoam™ commercially available from Baker Hughes Incorporated Houston, Tex.). In one embodiment an inner core 18 may comprise an expandable material that is also fluid permeable to allow axial through passage, radial through passage or both. In yet another embodiment, the expandable material may be coated with a fluid impervious material to create a liner within the tubular form 16. Further, an expandable material that is dissolvable may be substituted to ensure a patent ID after setting of the device 10. Further, the expandable material is disposed centrally relative to the building elements to assist in moving the building elements to the lower energy level.

In one embodiment a through-tubing annular isolation device comprising a plurality of building elements tethered sequentially together such that a tubular form is achieved at a lower energy condition and a dimensionally smaller form is achieved at a higher energy condition.

Figure 5:
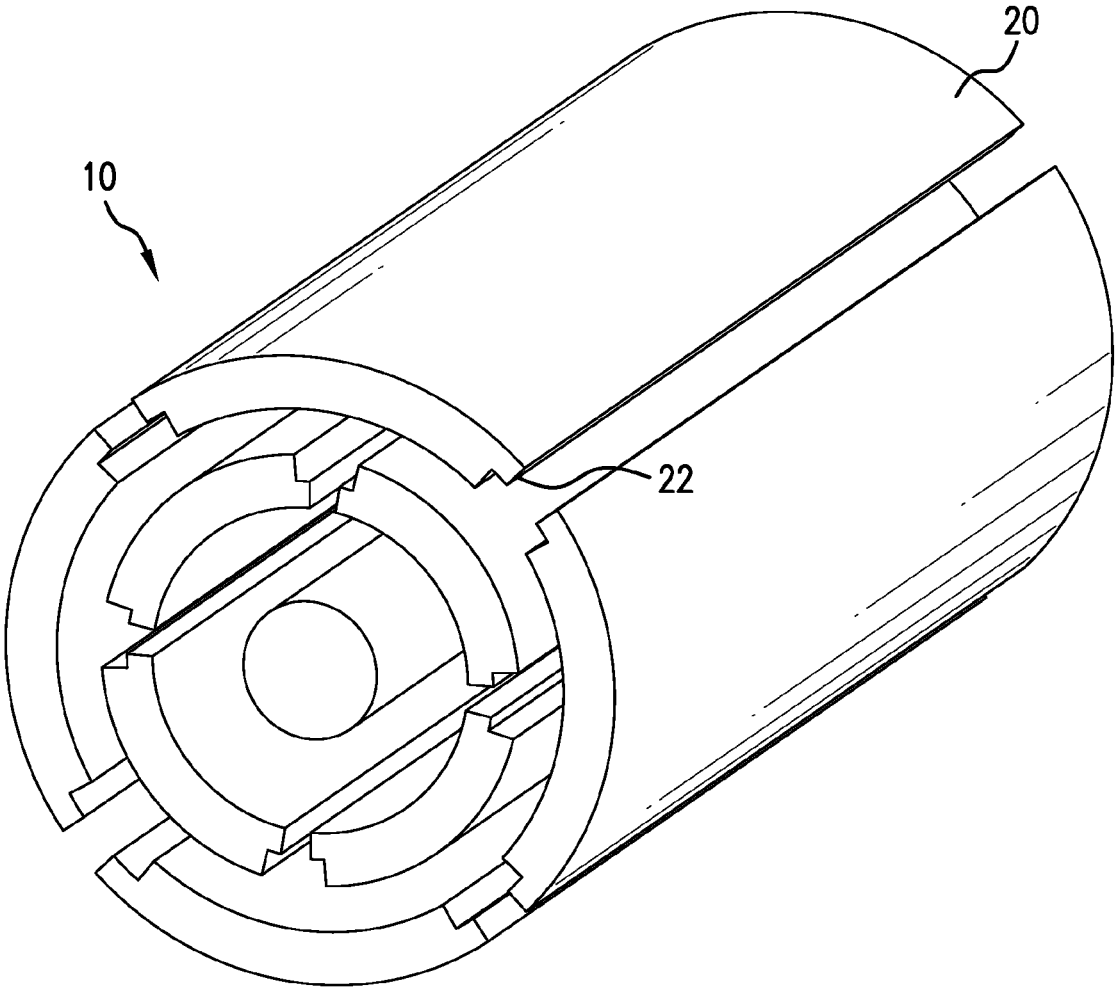
FIG. 5 is a schematic illustration of another embodiment of a through-tubing deployed annular isolation device having multiple slats in a collapsed form.
Figure 6:
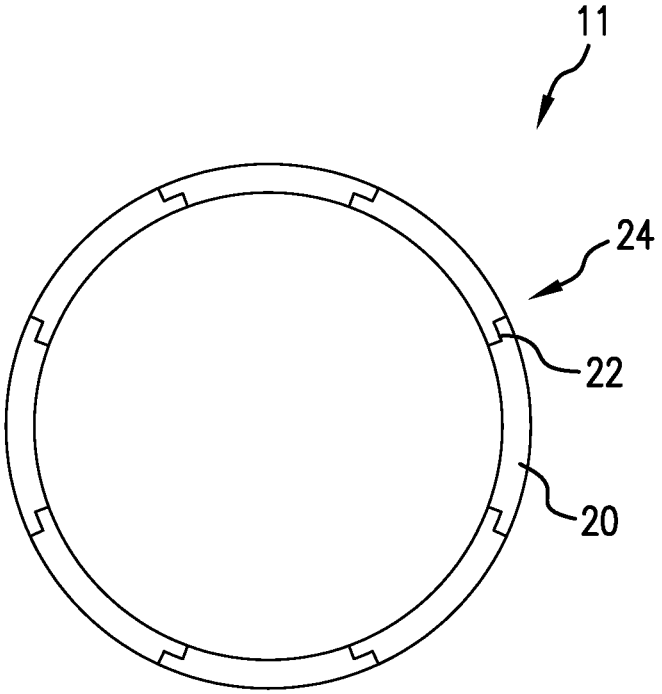
FIG. 6 is the embodiment of FIG. 5 in a deployed form.

Referring to FIG. 5, an alternate configuration of the through-tubing annular isolation device 10 is illustrated. This embodiment employs a number of building elements such as slats 20 configured to engage each other from radial edge to radial edge in order to form a tube when deployed, see FIG. 6. The tube may be round as shown or other shapes. As illustrated, and it is to be appreciated that any number of slats may be employed in iterations of the configuration of FIG. 5, there are eight slats 20. Each of the slats includes a radial edge detail 22 that is engageable with a slat 20 that is to be disposed in adjacent contact therewith in the deployed condition. As shown, the edge details 22 are "shiplap" details. The illustration is by way of example only as any other detail may also be employed provided that the interconnection resulting therefrom is stable. As in the embodiments of FIG. 1, a tether or some type is employed. The tether may be one or more elastic elements or may be the provision of magnetized edges. Also similarly to FIG. 1, sealing and or expansion materials as disclosed relative to FIG. 1 are applicable to this embodiment. FIG. 6 illustrates the slats in the lower energy configuration and in a tubular form 24 that happens in this case to be cylindrical.

Figure 7:
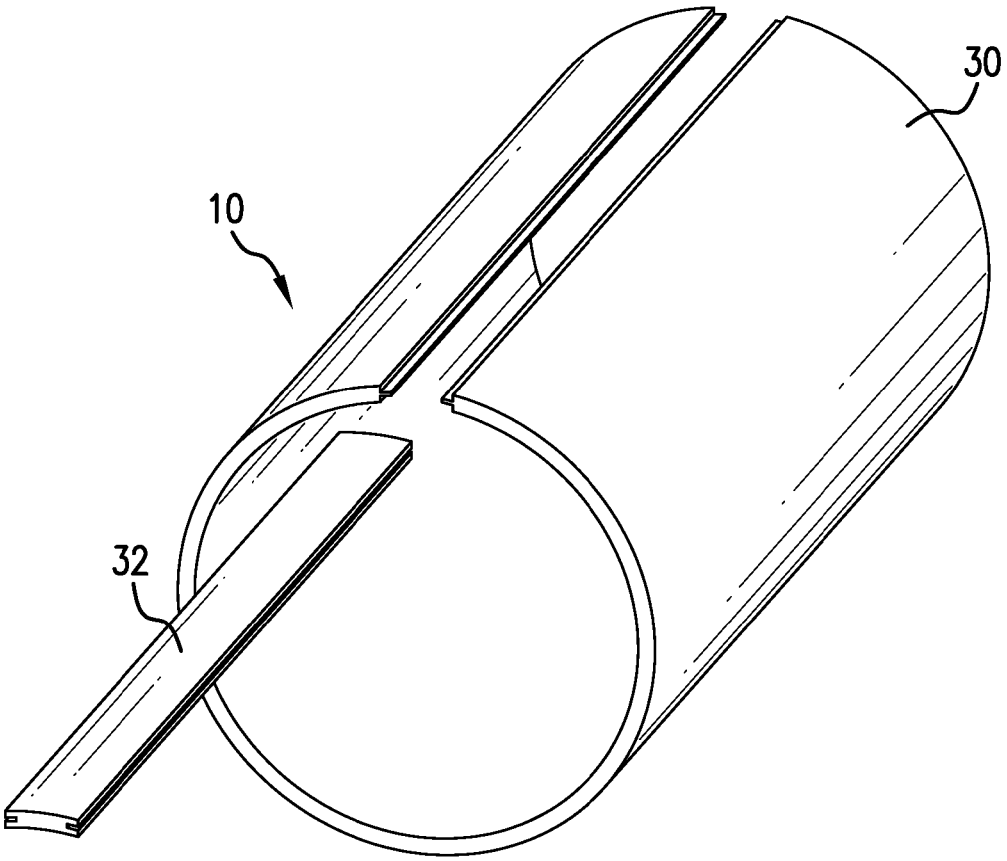
FIG. 7 is a schematic illustration of yet another embodiment of a through-tubing deployed annular isolation device having a body and a single slat in a collapsed form.
Figure 8:
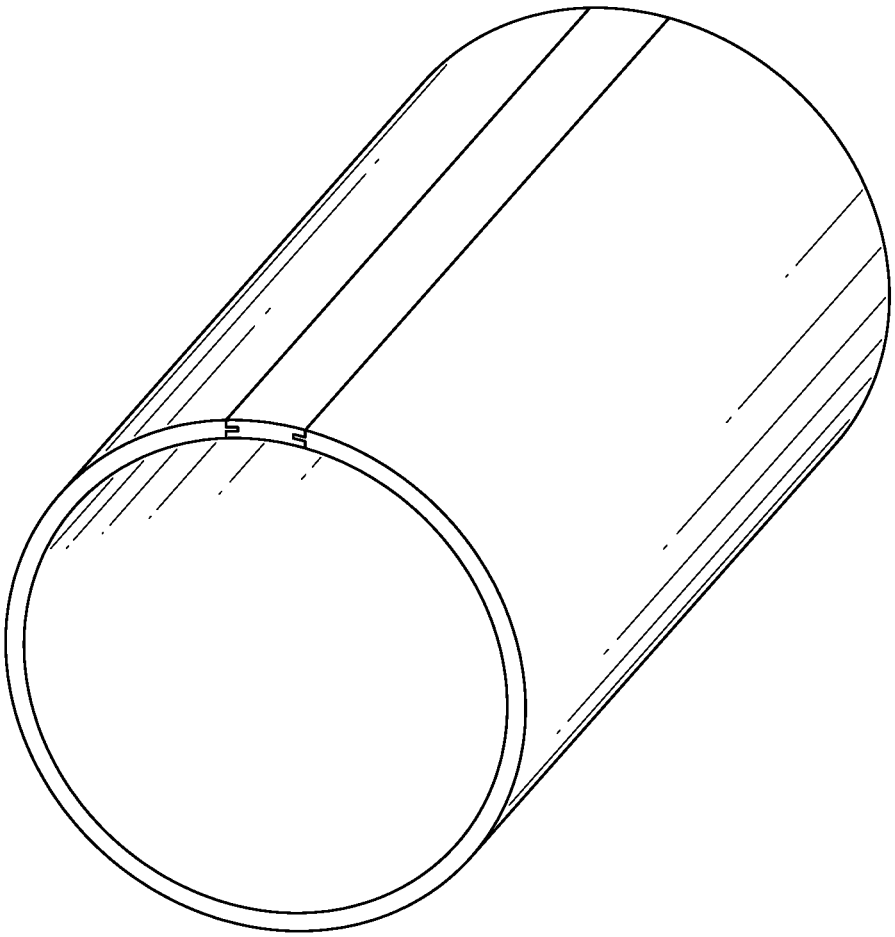
FIG. 8 is the embodiment of FIG. 7 in a deployed form.

Referring to FIGS. 7 and 8, another embodiment is illustrated that includes a body portion 30 and a single slat 32. Upon removal of the slat 32, the body 30 may be urged to a smaller diameter dimension. It will be appreciated that this embodiment provides for a smaller reduction in dimension in the first energy condition than the previous embodiments but is enhanced in its ability to be reconfigured back the second energy condition. This embodiment too may be configured with the first energy condition being higher or lower than the second energy condition. The arc length of the slat 32 may be up to 180 degrees if desired. This embodiment is run in the hole with the slat axially displaced from the body and then forced into the body via hydraulic or mechanical force when deployment is desired. It is to be understood that this embodiment may be configured with all of the sealing and or expanding concepts discussed with respect to FIG. 1.

A method for isolating an annular space through-tubing is contemplated using the embodiments set forth above. The method includes inserting one of the embodiments set forth above at a higher energy level into a tubing; running the device through the tubing; and deploying the device beyond the tubing.

Generally, the method begins with collapsing the device to the higher energy condition unless the collapsing is done in advance to reduce time on the rig. Once the device is at the target location, it is deployed by either allowing the device to achieve its own lower energy level or by expanding an expandable material within the device. Sealing may be brought about by activating a sealing material such as a swellable material. In an embodiment, the deploying includes swelling a swellable material about the device which may in some instances seal the device to itself and/or to a surrounding structure.

Set forth below are some embodiments of the foregoing disclosure:

Embodiment 1

A through-tubing annular isolation device comprising a plurality of building elements tethered sequentially together such that a tubular form is achieved at a second energy condition and a dimensionally smaller form is achieved at a first energy condition.

Embodiment 2

The device of embodiment 1 wherein the building elements are blocks.

Embodiment 3

The device of embodiment 1 wherein the building elements are slats.

Embodiment 4

The device of embodiment 1 wherein the building elements are tethered with one or more elastic elements Embodiment 5

The device of embodiment 1 wherein the building elements are tethered with magnetism.

Embodiment 6

The device of embodiment 1 further comprising a sealing material.

Embodiment 7

The device of embodiment 6 wherein the sealing material is a swellable material.

Embodiment 8

The device of embodiment 6 wherein the sealing material is disposed upon one or more of the building elements.

Embodiment 9

The device of embodiment 1 further comprising an expandable material.

Embodiment 10

The device of embodiment 9 wherein the expandable material is disposed centrally relative to the building elements to assist in moving the building elements to the second energy condition.

Embodiment 11

The device of embodiment 9 wherein the expanding material is dissolvable.

Embodiment 12

The device of embodiment 9 wherein the expanding material is fluid permeable.

Embodiment 13

The device of embodiment 1 wherein the first energy condition is higher than the second energy condition Embodiment 14

The device of embodiment 1 wherein the first energy condition is lower than the second energy condition.

Embodiment 15

A through tubing annular isolation device comprising a plurality of building elements tethered or assembled together such that the building elements are dimensionally passable through an inside dimension of a tubing string and such that a tubular form dimensionally larger than the inside dimension of the tubing string is achievable from the building elements when deployed beyond an end of the tubing string.

Embodiment 16

A method for isolating an annular space through-tubing comprising: inserting a device as claimed in claim 1 at a first energy condition into a tubing; running the device through the tubing; and deploying the device beyond the tubing.

Embodiment 17

The method of embodiment 17 wherein the inserting includes collapsing the device to the first energy condition.

Embodiment 18

The method of embodiment 17 wherein the deploying includes allowing the device to achieve its own second energy condition.

Embodiment 19

The method of embodiment 17 wherein the deploying includes expanding an expandable material within the device.

Embodiment 20

The method of embodiment 17 wherein the deploying includes swelling a swellable material about the device.

Embodiment 21

The method of embodiment 20 wherein the swelling includes sealing the device.

Embodiment 22

The method of embodiment 20 wherein the sealing is to another structure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A through-tubing annular isolation device comprising a plurality of building elements tethered sequentially together such that a tubular form is achieved at a second energy condition and a dimensionally smaller form is achieved at a first energy condition and wherein the first energy condition is higher than the second energy condition, the building elements being connected by one or more tethers in the first and second energy conditions, the first energy condition being higher as a result of stretching the one or more tethers.

2. The device as claimed in claim 1 wherein the building elements are blocks.

3. The device as claimed in claim 1 wherein the building elements are slats.

4. The device as claimed in claim 1 wherein the building elements are tethered with one or more elastic elements.

5. The device as claimed in claim 1 further comprising a sealing material.

6. The device as claimed in claim 5 wherein the sealing material is a swellable material.

7. The device as claimed in claim 5 wherein the sealing material is disposed upon one or more of the building elements.

8. The device as claimed in claim 1 further comprising an expandable material.

9. The device as claimed in claim 8 wherein the expandable material is disposed centrally relative to the building elements to assist in moving the building elements to the second energy condition.

10. The device as claimed in claim 8 wherein the expandable material is dissolvable.

11. The device as claimed in claim 8 wherein the expandable material is fluid permeable.

12. A method for isolating an annular space through-tubing comprising:

inserting a device as claimed in claim 1 at a first energy condition into a tubing;

running the device through the tubing; and deploying the device beyond the tubing.

13. The method as claimed in claim 12 wherein the inserting includes collapsing the device to the first energy condition.

14. The method as claimed in claim 12 wherein the deploying includes allowing the device to achieve its own second energy condition.

15. The method as claimed in claim 12 wherein the deploying includes expanding an expandable material within the device.

16. The method as claimed in claim 12 wherein the deploying includes swelling a swellable material about the device.

17. The method as claimed in claim 16 wherein the swelling includes sealing the device.

18. The method as claimed in claim 16 wherein the sealing is to another structure.

19. A through tubing annular isolation device comprising a plurality of building elements tethered or assembled together such that the building elements are dimensionally passable through an inside dimension of a tubing string and such that a tubular form dimensionally larger than the inside dimension of the tubing string is achievable from the building elements when deployed beyond an end of the tubing string, the tethered elements having a second energy condition and a dimensionally smaller first energy condition and wherein the first energy condition is higher than the second energy condition, the building elements being connected by one or more tethers in the first and second energy condition, the first energy condition being higher as a result of stretching the one or more tethers.

* * * * *